US005197408A

United States Patent [19]

Stoudt

[11] Patent Number: 5,197,408

[45] Date of Patent: Mar. 30, 1993

[54] INTEGRATED, SELF-STORING FLAG HOLDER

[75] Inventor: Theodore L. Stoudt, Lake Oswego, Oreg.

[73] Assignee: Sign-Up Corporation, Portland, Oreg.

[21] Appl. No.: 840,396

[22] Filed: Feb. 24, 1992

[51] Int. Cl.[5] ..... G09F 7/20

[52] U.S. Cl. ..... 116/173; 40/607; 116/63 P; 248/293

[58] Field of Search ..... 116/63 P, 173, 175; 248/293; 40/607

[56] References Cited

U.S. PATENT DOCUMENTS

| | | | |
|---|---|---|---|
| 3,273,273 | 9/1966 | McLanty | 116/173 |
| 4,333,575 | 6/1982 | Wong | 248/393 X |
| 4,569,499 | 2/1986 | Seely | 40/608 X |
| 4,619,220 | 10/1986 | Seely et al. | 116/63 P |
| 4,865,287 | 9/1989 | Stoudt | 116/173 X |

*Primary Examiner*—Daniel M. Yasich
*Attorney, Agent, or Firm*—Grant L. Hubbard

[57] ABSTRACT

An integrated self-storing flag holder for flags on flagstaffs that have an elongate slot in the proximal end, comprising a main support plate having positioning means to engage the elongate slots and elongate fasteners extending through the slots to secure the flagstaffs in display position and to permit the respective flagstaffs to pivot to the storage position is disclosed.

9 Claims, 2 Drawing Sheets

INTEGRATED, SELF-STORING FLAG HOLDER

BACKGROUND OF THE INVENTION

This invention relates to warning devices such as signs and flags that are used to warn the motoring public of highway hazards or construction.

The use of signs bearing various indicia, such as "ROADWORK AHEAD," "SLOW," etc are commonly used along highways, in parking areas, construction zones, and in other locations to warn and inform those approaching that certain conditions exist, that hazards may exist, or that certain actions may be required. Flags are very frequently used in connection with such signs or alone to attract the attention of the driver or other person. Many sign holders have been used. The most common approach is to provide a clamp or holder structure for receiving the staffs of two, three or more staff-mounted flags and for clamping the staffs in place. This requires that the flags be stored separately and be installed with each use.

An important feature of the present invention is to provide a single unit that includes the flags and permits the flags to be moved from a storage position to a display position, and back to the storage position.

A unique mechanism for permitting movement of flags from a first position for storage to a second position where the flags are locked into a display.

SUMMARY OF THE INVENTION

The present invention is an integrated self-storing flag holder for a plurality of flags on flagstaffs, each of the flagstaffs having formed proximate the distal end thereof an elongate slot therethrough. A main support plate having a plurality of positioning means to engage the elongate slot of the respective flagstaffs and a plurality of elongate fasteners extending through the slots of the respective flagstaffs secure the flagstaffs to the main support plate, in the display position thereof, and permit the respective flagstaffs to pivot about the respective elongate fastener. Means for locking the respective flagstaffs to the main support plate with the respective positioning means in engagement with the slots of the flagstaffs at a location spaced from the respective elongate fasteners are provided. The positioning means and elongate fasteners cooperate to fix the orientation of the flagstaff relative to the main support plate. The locking means is releasable to permit the respective flagstaffs to be moved to disengage the respective slots from the respective positioning means and pivot to the storage position.

The present invention comprises an integrated self-storing flag holder comprising a pivot and lock mechanism secured to a main support shaft, a plurality of flagstaffs having flags attached. The flagstaffs have elongate slots formed therein adjacent the proximal end. The pivot and lock mechanism comprises a main support plate and a locking plate for clamping the flagstaffs toward the main support plate. The main support plate has a generally V-shaped boss for orienting two of the flagstaffs upwardly and outwardly on opposite sides of the pivot and lock mechanism when the pivot and locking mechanism locks the flagstaffs in the display position. Generally circular bosses or raised portions for engaging the slots in the respective flagstaffs and elongate fasteners respectively, extending through the slots cooperate to lock the flagstaffs in display position and permit the flagstaffs to pivot thereabout to the storage position.

The locking plate comprises flanges separated by a slot through which one of the flagstaffs extends in the upper end thereof for locking the a flagstaff onto a boss against the main support plate and preventing lateral movement of the most proximal end of the flagstaff thereby locking the flagstaff in a generally vertical orientation relative to the main support plate in the normal use position thereof.

DESCRIPTION OF THE PREFERRED EMBODIMENT

The following description of the preferred embodiment is exemplary of one construction embodying the invention. Other constructions and variations may be used without departing from the invention.

Figure 1:
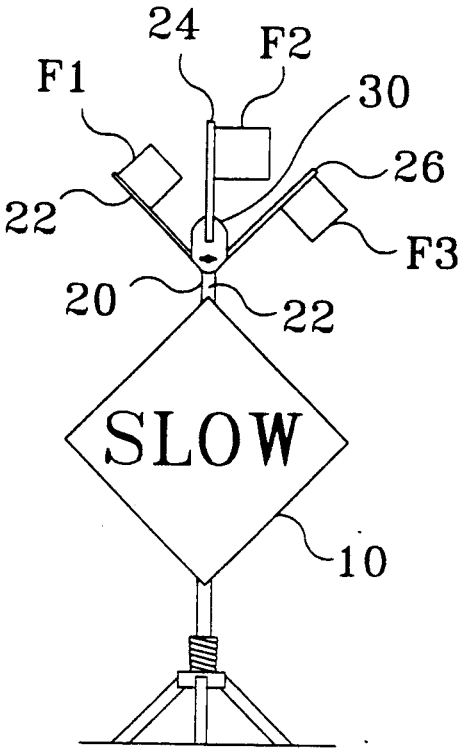
FIG. 1 is a generally schematic depiction of a typical sign and flag combination with which the present invention may be used.

Referring first to FIG. 1, a traffic warning sign combination 10 comprising a sign, base and support of any desired configuration to which the integrated self-storing flag holder 20 of this invention is affixed by any desired means. As will be noted from FIG. 1, the major components of the integrated self-storing flag holder 20 comprises a pivot and lock mechanism 30 and a main support shaft 22 supporting, as depicted, three flagstaffs 22, 24 and 26, that have attached to them flags $F_1$, $F_2$ and $F_3$.

Figure 2:
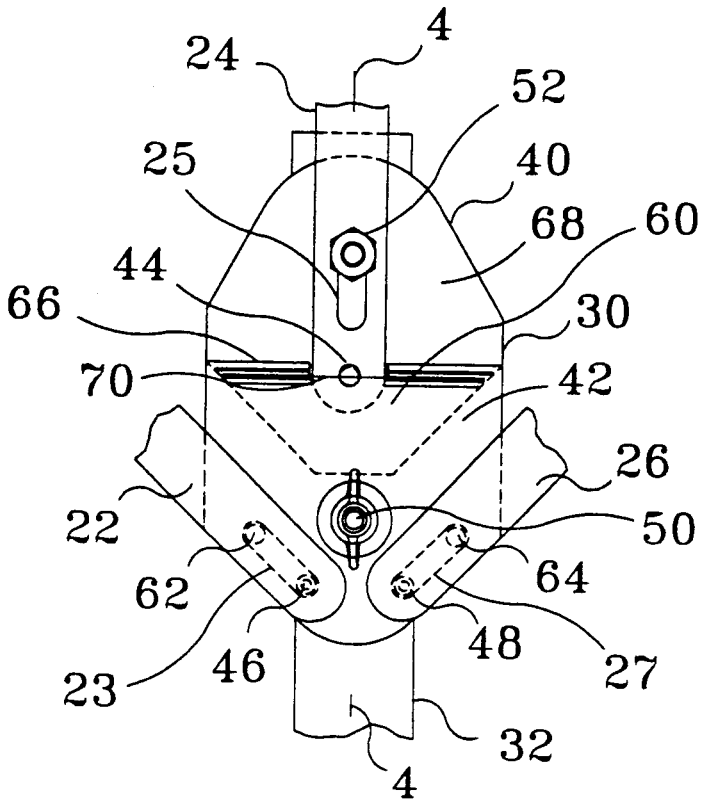
FIG. 2 is a front plan view of the pivot and lock mechanism for permitting the flagstaffs to pivot from a storage position to a display position and then to the storage position, the display position being shown.

Referring momentarily to FIG. 2, it will be seen that the pivot and lock mechanism 30 is attached to the main support shaft 22 and comprises a main support plate 40 and a locking plate 60.

Figure 4:
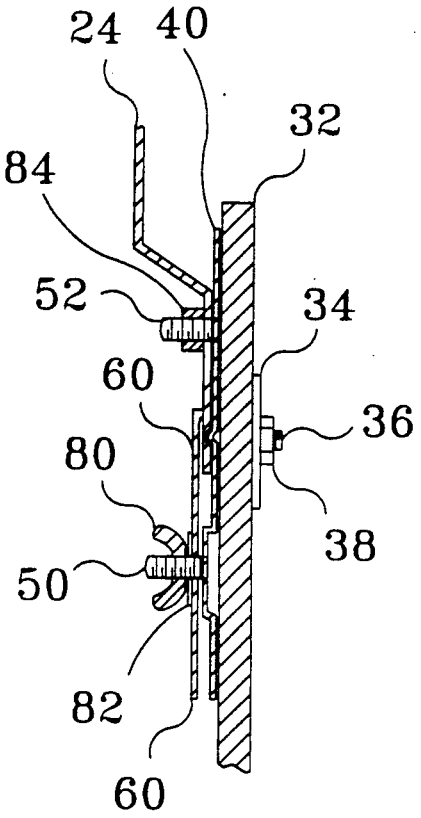
FIG. 4 is a side view in cross-section taken along lines 4—4 of FIG. 2 taken in the direction of the arrows showing the pivot and lock mechanism attached to a main support shaft.
Figure 5:
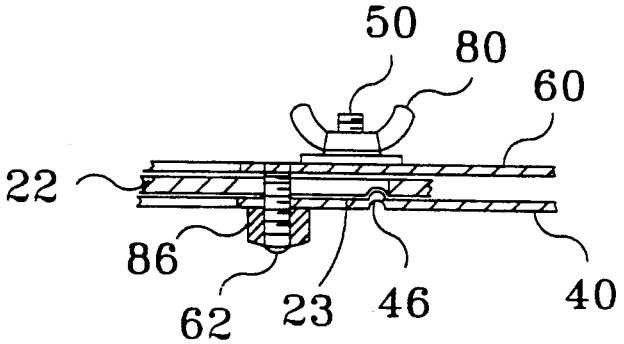
FIG. 5 is a generally vertical view, as depicted in FIG. 2, taken along lines 5—5 of FIG. 2 in the direction of the arrows, the main support shaft being omitted for clarity.
Figure 3:
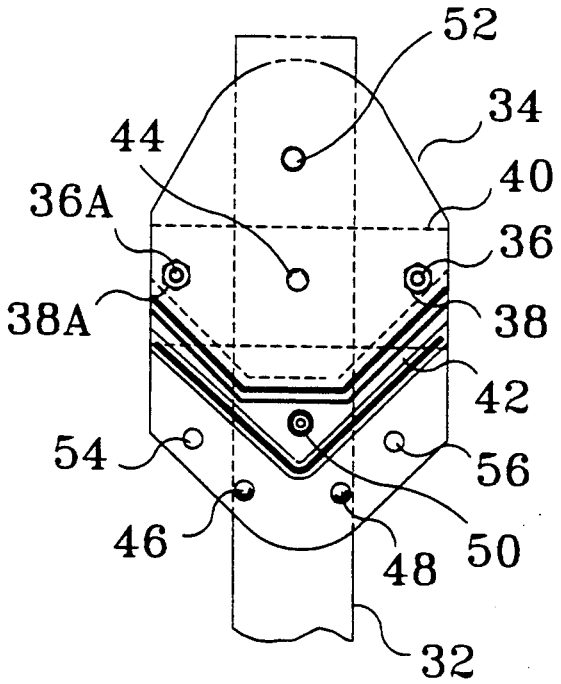
FIG. 3 is a front plan view of the main support plate that comprises part of the pivot and lock mechanism attached to a main support shaft.

The main support plate 40 will be described with specific reference to FIG. 3, and also to FIGS. 2, 4 and 5. The main support plate 40, in the preferred embodiment, is a generally rectangular plate having the upper and lower ends, as disposed in use, formed as radiused apex triangles, i.e. a generally triangular portion having the distal most point radiused. The shape of the main support plate is of no particular consequence, however, and any shape may be used.

The main support plate 40 is attached to the main support shaft 32 by means of a strap-like clamp 34, bolts 36 and **36*a* and nuts 38 and 38*a***. In the depicted embodiment, the main support shaft is a generally rectangular cross-sectioned resin bonded fiber glass shaft. It is important that one realize that the shape of the main support shaft is of no particular criticality or consequence.

More commonly, for example, the main support shaft may simply be a steel tube.

The important structural features of the main support plate comprise the following. A generally V-shaped boss 42 is formed in the plate, or added by a separate generally V-shaped component, or otherwise provided. The boss 42 fixes the position of two of the flags, 22 and 26, to extend upwardly and outwardly when the pivot and locking mechanism locks them in the display position. Three smaller, generally circular bosses or raised portions, again formed in the plate or added thereto, 44, 46 and 48, provide both positioning and locking functions when the mechanism locks the flags in display position. These circular bosses cooperate, respectively, with a bolt 52 that, if convenient, is welded to the main support plate, and with bolts extending through apertures 54 and 56 in the main support plate to lock the flags in the desired position and to prevent them from pivoting. A bolt 50 is conveniently welded to the boss portion 42 for clamping the locking plate 60 over the ends of the shafts 22, 24 and 26 to lock them in the display position when the flags are in use and to provide limited locking when the flags are in storage.

Making more specific reference now to FIGS. 3, 4 and 5, as well as to FIG. 2, the overall construction and functioning of the invention will be described. It will first be noted that a wingnut 80 and washer 82 on bolt 50 are provided as means for clamping the locking plate 60 to the main support plate and that nut 84 is provided on bolt 52 for keeping the flagstaff 24 secured to the mechanism. As best shown in FIG. 5, a nut 86 on a bolt 62 that is secured to the locking plate 60 keeps flagstaff 22 to the mechanism. A similar nut (not shown) is secured to another bolt 64 for keeping the flagstaff 26 secured to the mechanism. Vibration resistant nuts are preferred; however, any convenient means for keeping the flagstaffs secured to the mechanism may be used.

An elongate slot 23 is formed in the proximal end of flagstaff 22, a like slot 25 is formed in slot 24 and, in like manner, a slot 27 is formed in the proximal end of flagstaff 26. The bolts 62, 52 and 64, respectively, extend through the slots 23, 25 and 27 and comprise part of the locking mechanism and also perform the function of pivot pins. As shown in FIG. 2, with partial showings in FIGS. 4 and 5, the bosses 46 and 48, respectively, extend into the most proximal end of the respective slots 23 and 27 and, in cooperation with the bolts 62 and 64, respectively, and the locking plate 60, fix the flagstaffs, and hence the flags, in the display position as shown in FIG. 1.

The locking plate 60 comprises flanges 66 and 68 separated by a slot 70 in the upper end thereof, as viewed in FIG. 2, for locking the center flagstaff 24 onto the boss and preventing lateral movement of the most proximal end of the flagstaff 24, thereby locking the center flagstaff in a generally vertical orientation, as the invention is most commonly used, as depicted in an example in FIG. 1. The locking plate, when clamped to the main support plate by the bolt 52 and nut 80, or any convenient means, secures the slots in the flagstaffs over the bosses thereby preventing rotation of the flagstaffs.

For storage, the locking plate is loosened and the flagstaffs 22 and 26 are pulled outwardly and upwardly to a position where the slot can pivot on the bolts 62 and 64 to move the flagstaffs 22 and 26 to a substantially vertical orientation approximately parallel with flagstaff 24. In this position, the flags can conveniently be wrapped around all of the flagstaffs and, if desired, secured with a string or rubber band for storage and transportation.

The components of the pivot and locking mechanism, the flagstaffs, and the main support shaft may be made of any convenient material. The pivot and locking mechanisms are conveniently stamped of steel or aluminum, or any other metal or alloy, steel being preferred because welding is simpler than with aluminum and because of the greater strength and toughness of steel. The main support plate and/or locking plate may also be injection molded of a tough plastic such as polycarbonate, polyacetel, etc., or formed of resin bonded glass fibers. Indeed, the materials of construction are not critical and any materials of sufficient strength may be used.

With an understanding of the mechanisms of the invention, one will readily recognize its great advantages. The ability to provide in one mechanism the flagstaffs, flags and support greatly reduces the manpower required to position and display the flags. A very substantial cost attaches to the preparatory efforts before highway repair, for example, can begin and there is much lost time while flags and signs are erected. Thus, in addition to the direct savings, greater savings from greater productivity are accomplished. The mechanisms can be made using well-known techniques inexpensively on a mass production basis. The problems of lost flags, especially in high winds, that have afflicted the prior art are done away with and a new era of efficiency and safety rises over the industry.

INDUSTRIAL APPLICATION

This invention is useful in the highway repair and construction industry, in vehicle parking lots and in other locations where it is desirable to attract the attention of those approaching a location or activity.

What is claimed is:

1. An integrated self-storing flag holder assembly comprising:

a plurality of flags on flagstaffs, each of the flagstaffs having formed proximate the distal end thereof an elongate slot therethrough;

a main support plate having a plurality of positioning means so constructed and adapted as to engage the elongate slot of the respective flagstaffs;

a plurality of elongate fasteners extending through the slots of the respective flagstaffs for securing the flagstaffs to the main support plate and for permitting the respective flagstaffs to pivot about the respective elongate fastener; and means for locking the respective flagstaffs to the main support plate with the respective positioning means in engagement with the slots of the flagstaffs at a location spaced from the respective elongate fasteners, the positioning means and elongate fasteners cooperating to fix the orientation of the flagstaff relative to the main support plate, said locking means being releasable to permit the respective flagstaffs to be moved to disengage the respective slots from the respective positioning means.

2. The integrated self-storing flag holder of claim 1 wherein the positioning means are bosses on the main support plate.

3. The integrated self-storing flag holder of claim 2 wherein the locking means is a locking plate and a clamping means for clamping the locking plate toward the main support plate.

4. The integrated self-storing flag holder of claim 3 wherein the locking plate has formed thereon flanges extending toward the main support plate on each side of a flagstaff for preventing lateral movement of the proximal end of the flagstaff.

5. The integrated self-storing flag holder of claim 1 wherein the positioning means are bosses on the main support plate.

6. The integrated self-storing flag holder of claim 3 wherein the locking means comprises a locking plate having formed thereon flanges extending toward the main support plate on each side of a flagstaff for preventing lateral movement of the proximal end of the flagstaff.

7. The integrated self-storing flag holder of claim 6 wherein the positioning means are bosses on the main support plate.

8. An integrated self-storing flag holder (20) comprising a pivot and lock mechanism (30) secured to a main support shaft (22), a plurality of flagstaffs (22, 24 26) having attached, respectively, thereto flags ($F_1$, $F_2$, $F_3$), and having formed in adjacent the proximal end thereof, respectively, elongate slots (23, 25, 27), the pivot and lock mechanism 30 comprising a main support plate 40 and a locking plate 60 for clamping the flagstaffs toward the main support plate, the main support plate 40 comprising a generally V-shaped boss 42 for orienting two of the flagstaffs (22, 26) upwardly and outwardly on opposite sides of the pivot and lock mechanism when the pivot and locking mechanism locks the flagstaffs in the display position, generally circular bosses or raised portions (44, 46, 48) for engaging the slots (23, 25, 27) in the respective flagstaffs (22, 24, 26), and elongate fasteners (62, 52 and 64), respectively, extending through the slots (23, 25, 27) for cooperating with the respective bosses for locking the flagstaffs in display position and for permitting the flagstaffs to pivot thereabout to the storage position.

9. The integrated self-storing flag holder of claim 8 wherein the locking plate (60) comprises flanges (66, 68) separated by a slot (70) through which one of the flagstaffs (24) extends in the upper end thereof for locking the a flagstaff (24) onto the boss (44) against the main support plate (40) and preventing lateral movement of the most proximal end of said flagstaff 24 thereby locking said flagstaff in a generally vertical orientation relative to the main support plate in the normal use position thereof.

* * * * *